United States Patent [19]

Veglio

[11] Patent Number: 4,860,722

[45] Date of Patent: Aug. 29, 1989

[54] DIAMOND SEGMENTS AND INSERTS

[75] Inventor: Oreste Veglio, Pianezza, Italy

[73] Assignee: HS Veglio S.r.l., Pianezza, Italy

[21] Appl. No.: 185,304

[22] Filed: Apr. 20, 1988

Related U.S. Application Data

[63] Continuation of Ser. No. 937,723, Dec. 4, 1986, abandoned.

[30] Foreign Application Priority Data

Dec. 13, 1985 [IT] Italy ..... 68048 A/85

[51] Int. Cl.[4] ..... B24D 7/06; B24D 7/10

[52] U.S. Cl. ..... 125/15; 51/206.4; 51/209 R

[58] Field of Search ..... 51/206 R, 206.4, 209 R; 125/15, 18

[56] References Cited

U.S. PATENT DOCUMENTS

| | | | |
|---|---|---|---|
| 2,804,733 | 9/1957 | Hurst | 51/209 R |
| 3,016,661 | 1/1962 | Nielsen . | |
| 3,041,799 | 7/1962 | Kemman . | |
| 3,049,843 | 8/1962 | Christensen | 125/15 |
| 3,117,400 | 1/1964 | Martin | 51/209 R |
| 3,386,214 | 6/1968 | Shoemaker | 51/209 R |
| 3,426,486 | 2/1969 | Kubsh | 51/209 R |
| 3,440,773 | 4/1969 | Hawkes . | |
| 3,494,348 | 2/1970 | Lindblad | 51/209 R |
| 3,657,845 | 4/1972 | Sekiya . | |
| 3,711,999 | 1/1973 | Held . | |
| 4,665,887 | 5/1987 | Shiqa | 125/15 |

FOREIGN PATENT DOCUMENTS

| | | | |
|---|---|---|---|
| 568518 | 6/1958 | Belgium . | |
| 138237 | 4/1985 | European Pat. Off. | 125/15 |
| 137647 | 4/1902 | Fed. Rep. of Germany . | |
| 172813 | 12/1917 | Fed. Rep. of Germany . | |
| 743122 | 12/1943 | Fed. Rep. of Germany . | |
| 956742 | 1/1957 | Fed. Rep. of Germany . | |
| 3340480 | 4/1985 | Fed. Rep. of Germany . | |
| 1104941 | 11/1955 | France . | |
| 1195595 | 11/1959 | France . | |
| 57-201119 | 12/1982 | Japan . | |
| 180775 | 9/1985 | Japan | 125/15 |

*Primary Examiner*—Robert P. Olszewski

*Attorney, Agent, or Firm*—Arnold, White & Durkee

[57] ABSTRACT

A diamond segment or insert for the cutting of hard materials and provided with dead holes formed in one of its faces and shaped and distributed in such a way that all the cross-sections perpendicular to the longitudinal axis of the tool originate full surfaces whose areas are all substantially equal to each other and in a constant ratio with the area of the rated cross-section of the tool, whatever the degree of wear of the tool may be; the holes have a depth greater than half the thickness of the tool and are disposed on the disk or the tool intended to be used for the cutting alternately turned through 180° with respect to each other; the holes may be filled with an aphonous abrasive or superabrasive material.

6 Claims, 1 Drawing Sheet

Fig.1
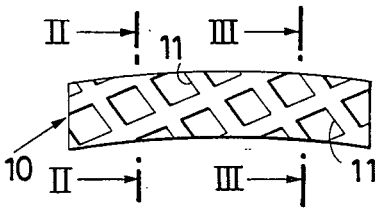
Fig.2
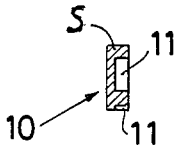
Fig.3
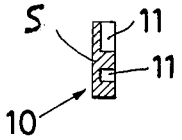
Fig.4
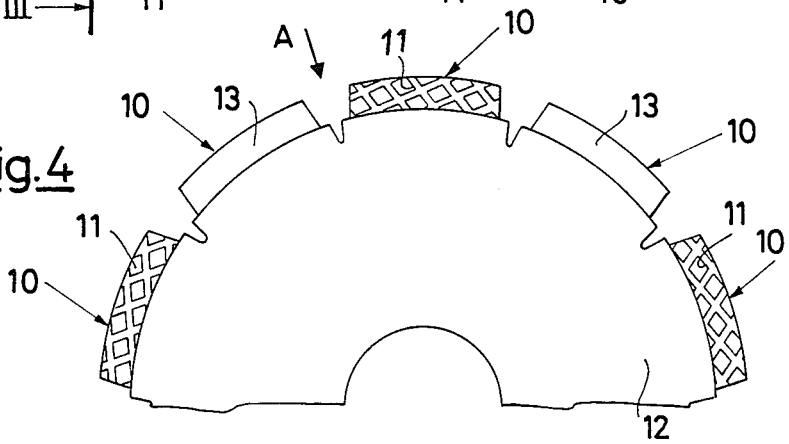
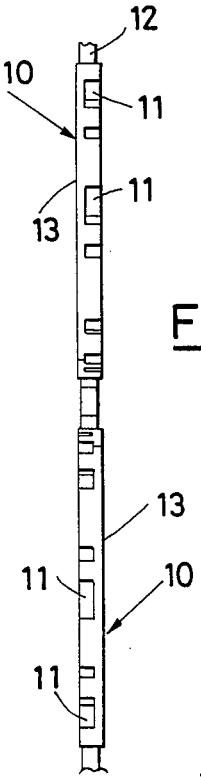
Fig.5
Fig.6
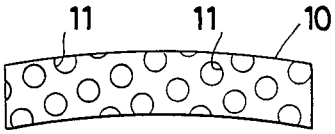
Fig.7
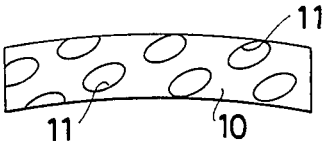
Fig.9
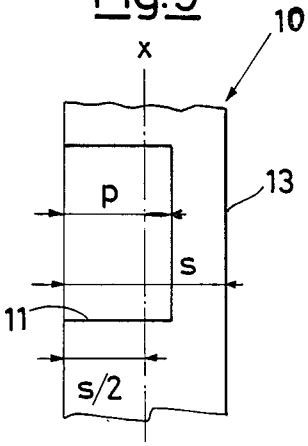
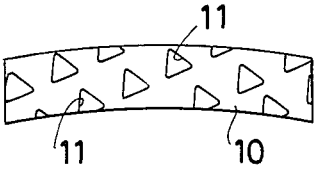
Fig.8

DIAMOND SEGMENTS AND INSERTS

This is a continuation of application Ser. No. 937,723, filed Dec. 4, 1986, now abandoned.

DESCRIPTION

This invention relates to the diamond segments and inserts used as tools of disks, milling cutters and saws for the cutting and the polishing of granites, stones, marbles, concrete, asphalt and analogous hard materials.

For being considered as optimum, these tools (segements and inserts) must have various requisites, among which such mechanico-structural characteristics as to enable obtaining perfectly linear cuts without chippings on the edges of the material to be cut.

Furthermore, it is useful for the cutting to be carried out quickly in order to ensure the smallest possible consumption of current during the work and to enable reducing the operating costs whereas the tool should be worn out uniformly along the cutting surface in order to have a satisfactorily long life.

The tool has also to aid in reducing as much as possible the noise during the cutting and, in some cases, it should also enable to obtain a good surface polishing of the cut material.

All these requisites are very important in the tools of this type; but they are never present all of them in the same tool.

The object of the invention is to provide a tool which will possess all the characteristics mentioned above and at the same time will be low cost of production, contrarily to other tools existing on the market which are very expensive and enable to obtain only some of the advantages mentioned hereinabove.

Among the known tools there are, for example, the so-called sandwich segments formed by an inner layer of soft material enclosed between outer layers of a more resisting material or between two outer layers having a higher concentration of diamonds as compared with that of the inner layer. This tool, very expensive to manufacture in both cases, enables to obtain an even surface wear of the tool without rounding off the edges, but does not possess any of the characteristics mentioned above.

This applies to the tools which are cut centrally or axially or are provided with through holes, which tools, though providing a good cooling during the cutting, have a very high cost of production and are subjected to an irregular and quick wear.

For attaining these and other objects which will be more clearly apparent from the following description, the invention provides a diamond segment or insert for the cutting of hard materials, characterized in being provided on one of its main surfaces with dead holes which are shaped and distributed in such a manner that all the cross-sections perpendicular to the longitudinal axis of the tool originate full surfaces whose areas are all of them substantially equal to each other and in a constant ratio with the rated cross-section of the tool, whatever the degree of wear of the tool may be.

BRIEF DESCRIPTION OF THE DRAWINGS

An embodiment of the tool according to the invention will now be described with reference to the annexed drawing, in which:

FIG. 1 is a front view of the tool according to the invention in a preferred embodiment thereof;

FIGS. 2 and 3 are cross-sections along lines II—II and III—III of FIG. 1.;

FIG. 4 is a partial view of a disk carrying the tools according to the invention;

FIG. 5 is a partial view of the disk of FIG. 4 in the direction of the arrow A;

FIGS. 6, 7 and 8 show further configurations of the tool according to the invention;

FIG. 9 is an enlarged view of a detail fo the tool shown in FIG. 5.

DETAILED DESCRIPTION OF THE DRAWINGS

The diamond segment 10 according to the invention is provided with recesses 11 formed on one of its main surfaces. The recesses, in the embodiment shown in FIGS. from 1 to 5, have a quadrilateral cross-section and are distributed obliquely in both directions relative to the orthogonal axes of the segment.

This is carried out according to the invention in such a manner that in whatever portion of the tool a cross-section is made (see for example the cross-sections II—II and III—III of FIGS. 2 and 3), global full surfaces S of substantially equal area are obtained, indemendently of the way the recesses 11 are positioned therein.

Moreover, according to the invention the sectors 10 are mounted on the disk 12 in such a manner that on each face thereof there will appear alternately the full surface 13 and the surface provided with holes 11, as shown in FIG. 4. In other caes, also two sectors turned in a direction could alternate with as many sectors turned in the opposite direction.

Furthermore, according to the invention the holes 11 have a depth p (FIGS. 5 and 9) greater than the half s/2 of the thickness of the segment itself, and more advantageously a depth equal to about $\frac{2}{3}$ of s.

The represented distribution of the holes 11 ensures that during the work, and accordingly during the wear of the tool, this latter will always keep such a structure that the surfaces S of its vertical cross-sections, though being reduced, will remain substantially equal to each other till the complete wear of the tool.

This gives rise to an optimum cutting balance of the tool and conquently a more homogeneous and correct wear thereof.

Moreover, the openings 11 which always appear on the cutting surface of the tool (see FIG. 5) permit a high cutting speed thanks to the reduction of the metal friction surface as compared with a solid tool, and hence a smaller consumption of current, the material to be cut being equal.

The cut is optimum and the tool wears out uniformly on the cutting surface, inasmuch as, according to the invention, the depth of the slots 11 which appear on the cutting surface is greater than half the thickness of the tool, and the tools are alternately turned through 180° on the disk. Accordingly, during the work the global cutting surface formed by the sum of the cutting surfaces of all the tools, has an intermediate linear portion having the width $2(p-s/2)$ which extends from the two sides of the center line x of the cutting surface, whose area is smaller than that of the two portions $s-P$ which lie laterally with respect to it.

In this way, although all the tools are formed by a single alloy of materials, a total cutting surface of the sandwich-type disk is obtained in which the side portions having, both of them, a thickness s−p, have a surface larger than the intermediate surface whose thickness is 2 (p−s/2), and accordingly the result is that the side edges are more resisting than the center line, which gives rise to a uniform linear wear of the tools with no excessive roundings along the edges.

The presence of the openings 11 on the cutting surface of the tools gives rise also to a reduction of the cutting noise because, thanks to the discontinuites of the surface, the vibrations are not transferred towards the core of the disk, but extinguish in the holes of the tool.

If, in addition thereto, the holes 11 are filled with an aphonous material, the disk becomes even more noiseless during the working, whereas if the material with which the holes are filled is of the abrasive or superabrasive type the disk provides a smoothing and a perfect polishing of the machined surface which in many cases does not require any further working.

As already pointed out, the balancing of the insert is a fundamental feature and is obtained, according to the invention, by distributing the holes 11 in such a way that the surfaces of all its vertical cross-sections are of equal quadrature, both when the tool is a new one and when it gradually wears.

This is obtained, according to the preferred embodiment shown in FIG. 1, with quadrilateral holes positioned obliquely relative to the axes of the segment, but it can be obtained also with other types of holes 11, for example round (FIG. 6) or oval elongated (FIG. 7) or triangular (FIG. 8) or of any other shape, provided they are positioned and distributed in such a manner as to enbale to always obtain the balancing effect mentioned hereinabove.

I claim:

1. A cutting disk for global cutting comprising:

(a) a disk;

(b) a plurality of hardened inserts uniformly disposed around the periphery of the disk;

(c) each insert includes a first and second main surface that are disposed substantially parallel to each other;

(d) the distance between the main surfaces defines the insert's thickness;

(e) the first main surface includes a plurality of uniformly spaced openings having substantially the same cross sections and the second main surface being free of openings;

(f) the depth of each opening is at least one-half the thickness of the inserts; and (g) the inserts are disposed on the periphery of the disk where:

(i) the main surfaces are disposed perpendicular to the longitudinal axis of the disk;

(ii) the openings are arranged in rows which are obliquely oriented with respect to longitudinal axis of the disk; and (iii) each insert is turned 180° with respect to the adjacent inserts, wherein the disk when viewed from the side includes a plurality of inserts where every other insert includes openings.

2. A claim according to claim 1 where the cross section of each of the openings is rectangular.

3. A claim according to claim 1 where the cross section of each of the openings is circular.

4. A claim according to claim 1 where the cross section of each of the openings is oval.

5. A claim according to claim 1 where the cross section of each of the openings is triangular.

6. A claim according to claim 1 where the depth of each of the openings is 0.67 times the thickness of the insert.

* * * * *

UNITED STATES PATENT AND TRADEMARK OFFICE

CERTIFICATE OF CORRECTION

PATENT NO. : 4,860,722

DATED : August 29, 1989

INVENTOR(S) : Oreste Veglio

It is certified that error appears in the above-identified patent and that said Letters Patent is hereby corrected as shown below:

Column 2, line 11, change "fo" to --of--.

lines 26-27, change "in-demendently" to --independently--.

line 33, change "caes" to --cases--.

line 47, change "conquently" to --consequently--.

Signed and Sealed this

Sixth Day of March, 1990

*Attest:*

JEFFREY M. SAMUELS

*Attesting Officer*

*Acting Commissioner of Patents and Trademarks*